US009073234B2

(12) United States Patent
Ito et al.

(10) Patent No.: US 9,073,234 B2
(45) Date of Patent: Jul. 7, 2015

(54) CUTTING METHOD OF HONEYCOMB DRIED BODY AND HONEYCOMB DRIED BODY CUTTING DEVICE

(75) Inventors: Yuji Ito, Nagoya (JP); Yohei Takemori, Nagoya (JP); Atsushi Watanbe, Inazawa (JP)

(73) Assignee: NGK Insulators, Ltd., Nagoya (JP)

( * ) Notice: Subject to any disclaimer, the term of this patent is extended or adjusted under 35 U.S.C. 154(b) by 612 days.

(21) Appl. No.: 13/433,018

(22) Filed: Mar. 28, 2012

(65) Prior Publication Data

US 2012/0252323 A1 Oct. 4, 2012

(30) Foreign Application Priority Data

Mar. 30, 2011 (JP) ..... 2011-074317

(51) Int. Cl.

| | |
|---|---|
| ***B24B 27/06*** | (2006.01) |
| ***B24B 19/22*** | (2006.01) |
| ***B28B 11/12*** | (2006.01) |
| ***B24B 27/00*** | (2006.01) |

(52) U.S. Cl.

CPC ..... *B28B 11/12* (2013.01); *B24B 27/0069* (2013.01); *B24B 27/0675* (2013.01)

(58) Field of Classification Search

CPC ..... B24B 27/0069; B24B 27/0675; B28B 11/12; Y10T 29/49345; Y10T 29/49998

USPC ..... 451/41, 278; 83/13; 264/630; 156/89.22

See application file for complete search history.

(56) References Cited

U.S. PATENT DOCUMENTS

| | | | | |
|---|---|---|---|---|
| 6,402,004 | B1 | 6/2002 | Yoshikuni et al. | |
| 6,612,300 | B2 * | 9/2003 | Mukota et al. | 125/20 |
| 7,708,933 | B2 * | 5/2010 | Kasai et al. | 264/605 |
| 7,815,994 | B2 * | 10/2010 | Ohno et al. | 428/116 |
| 8,277,921 | B2 * | 10/2012 | Imaeda et al. | 428/116 |
| 8,349,124 | B2 * | 1/2013 | Mizuno et al. | 156/325 |
| 8,349,432 | B2 * | 1/2013 | Higuchi | 428/116 |
| 8,480,780 | B2 * | 7/2013 | Kudo et al. | 55/523 |
| 8,574,386 | B2 * | 11/2013 | Sato | 156/89.22 |
| 2003/0014856 | A1 * | 1/2003 | Yamaguchi et al. | 29/559 |
| 2003/0064126 | A1 | 4/2003 | Miyazaki et al. | |
| 2006/0289501 | A1 * | 12/2006 | Michiwaki et al. | 219/687 |

(Continued)

FOREIGN PATENT DOCUMENTS

| | | |
|---|---|---|
| CN | 1404935 A | 3/2003 |
| CN | 101484288 A | 7/2009 |

(Continued)

OTHER PUBLICATIONS

Japanese Office Action dated Apr. 30, 2013.

(Continued)

*Primary Examiner* — Joseph J Hail
*Assistant Examiner* — Marc Carlson
(74) *Attorney, Agent, or Firm* — Burr & Brown, PLLC

(57) ABSTRACT

There is disclosed cutting means of a honeycomb dried body in which cracks are not easily generated in the honeycomb dried body, even when a grindstone continues to be used for a long period of time, a cutting speed is raised and a cutting object is a honeycomb dried body having a large diameter. There is provided a cutting method of a honeycomb dried body to cut the honeycomb dried body while applying a force Pm which resists a thrust force Pt required for the cutting and a weight Pw of a cutoff section, to a portion which becomes the cutoff section.

14 Claims, 6 Drawing Sheets

(56) References Cited

U.S. PATENT DOCUMENTS

| | | | | |
|---|---|---|---|---|
| 2007/0277655 | A1* | 12/2007 | Kawai et al. | 83/13 |
| 2008/0088072 | A1* | 4/2008 | Kobayashi | 269/9 |
| 2009/0249579 | A1 | 10/2009 | Aramaki et al. | |

FOREIGN PATENT DOCUMENTS

| | | | | | |
|---|---|---|---|---|---|
| JP | 2608672 | B2 | | 5/1997 | |
| JP | 2003-053723 | A1 | | 2/2003 | |
| JP | 2003220605 | A | * | 8/2003 | B28B 11/14 |
| JP | 2003266420 | A | * | 9/2003 | B28B 11/14 |
| JP | 2005-049270 | A1 | | 2/2005 | |
| JP | 2006123346 | A | * | 5/2006 | |
| JP | 2007-320312 | A1 | | 12/2007 | |

OTHER PUBLICATIONS

Chinese Office Action (Application No. 201210087347.5) dated Dec. 31, 2014.

* cited by examiner

CUTTING METHOD OF HONEYCOMB DRIED BODY AND HONEYCOMB DRIED BODY CUTTING DEVICE

BACKGROUND OF THE INVENTION

1. Field of the Invention

The present invention relates to a cutting method of a honeycomb dried body, and a honeycomb dried body cutting device.

2. Description of Related Art

In recent years, a filter and a catalyst have been provided in exhaust systems of automobiles to remove fine particles and harmful substances from exhaust gases in consideration of influences on environments. Moreover, as a filter element or a catalyst loading member, a honeycomb structure is used. In particular, regulations on the removal of a particulate matter (PM) discharged from a diesel engine are directed to strengthen globally. Also as a filter for removing the PM (a diesel particulate filter (DPF)), the honeycomb structure is used.

The honeycomb structure is a ceramic product, whose outer shape is usually a columnar body or a prismatic body, including a plurality of cells which are partitioned by partition walls made of a ceramic porous material to become through channels of a gas (having a honeycomb configuration). This honeycomb structure can be obtained by extruding a clay made of a kneaded ceramic material so that the clay has the honeycomb configuration, further forming an outer peripheral wall to obtain a honeycomb formed body, drying the honeycomb formed body, and firing the obtained honeycomb dried body. Prior to the firing, the honeycomb dried body is cut into a desired dimension by a grindstone or the like to finish the outer shape.

It is to be noted that any prior art documents concerning the cutting of the honeycomb dried body have not been found, but examples of a prior art document concerning the cutting, the grindstone or the like can include Patent Documents 1 to 3.

PRIOR ART DOCUMENT

Patent Documents

[Patent Document 1] JP2608672
[Patent Document 2] JP-A-2005-049270
[Patent Document 3] JP-A-2003-053723

SUMMARY OF THE INVENTION

Problem to be Solved by the Invention

Heretofore, cracks have been generated sometimes in a cut honeycomb dried body (a product section of the body), when the honeycomb dried body is cut by using, for example, a wheel grindstone. The cracks are easily generated, when the number of times to use the wheel grindstone increases and abrasive grains of wheel grindstone wear, abrade or fall to increase a processing resistance. When a cutting speed is raised, the processing resistance similarly becomes large, and the cracks are easily generated. Furthermore, the larger the honeycomb dried body is, the more easily the cracks are generated.

The honeycomb dried body in which the cracks are generated cannot be shipped as a product (the honeycomb structure). Therefore, for the enhancement of a yield, it is necessary to decrease a generation ratio of the cracks. On the other hand, for cost reduction, it is important to lengthen the life of the wheel grindstone. Moreover, for the enhancement of a production efficiency, it is also necessary to meet the speeding up of the cutting. Furthermore, in recent year, a filter and a catalyst have been enlarged, and hence it has been required that even a large-size honeycomb dried body can stably be cut.

The present invention has been developed in view of such a situation, and an object thereof is to provide a cutting method of a honeycomb dried body in which cracks are not easily generated in the honeycomb dried body, even when cutting means such as a wheel grindstone continues to be used for a long period of time, a cutting speed is raised and a cutting object is a honeycomb dried body having a large diameter, and to provide a honeycomb dried body cutting device. As a consequence of repeated investigations, it has been found that a cause for the generation of cracks in the honeycomb dried body which is cut to become a product lies in that a cutoff section separated by the cutting moves, when cut, to peel off part of a product section (the honeycomb dried body which becomes the product). It has also been found that the above object can be achieved by the following means for preventing the movement of the cutoff section, whereby the present invention has been completed.

Means for Solving the Problem

That is, according to the present invention, there is first provided a cutting method of a honeycomb dried body, comprising: cutting the honeycomb dried body, whose outer shape is a pillar body, perpendicularly to an axial direction, to separate the body into a product section and a cutoff section, wherein the honeycomb dried body is cut while applying a force Pm which resists a thrust force Pt required for the cutting and a weight Pw of the cutoff section, to a portion which becomes the cutoff section (after cut).

In the cutting method of the honeycomb dried body according to the present invention, $Pt+Pw \leq Pm$ is preferably satisfied. That is, $Pt+Pw<Pm$ or $Pt+Pw=Pm$ is preferably satisfied.

In the cutting method of the honeycomb dried body according to the present invention, the force Pm is preferably applied to the vicinity of a cut portion as a portion at which the honeycomb dried body is separated into the product section and the cutoff section at the end of the cutting. The force Pm is applied to the portion which becomes the cutoff section, and hence the force Pm is preferably applied to the vicinity of the cut portion which becomes the cutoff section. Moreover, the force Pm resists the thrust force Pt required for the cutting and the weight Pw of the cutoff section. Therefore, when the force Pm is applied to the vicinity of the cut portion as the portion at which the honeycomb dried body is separated into the product section and the cutoff section at the end of the cutting, it is meant that the force Pm acts on a place limitlessly close to the portion at which the honeycomb dried body is finally and completely separated at the end of the cutting. This configuration is preferable.

In the cutting method of the honeycomb dried body according to the present invention, the outer shape of the honeycomb dried body is preferably a columnar body.

In the cutting method of the honeycomb dried body according to the present invention, the cutting can simultaneously be performed at two portions of the honeycomb dried body. In this case, the honeycomb dried body whose outer shape is the pillar body is cut perpendicularly to the axial direction to separate the body into the product section and two cutoff sections. The product section is a section which is fired later to become the honeycomb structure and finally becomes the above-mentioned DPF or the like.

Next, according to the present invention, there is provided a honeycomb dried body cutting device which cuts a honeycomb dried body, whose outer shape is a pillar body, perpendicularly to an axial direction, to separate the body into a product section and a cutoff section, comprising: disc-like cutting means for cutting the honeycomb dried body by rotating peripheral edges thereof; support means for supporting the honeycomb dried body with a portion which becomes the product section (after cut); conveyance means for conveying the cutting means or the support means so that the disc-like cutting means passes through a cut portion of the honeycomb dried body, in a state where the axial direction of the honeycomb dried body which is the pillar body is orthogonal to a planar direction of the disc-like cutting means; and force applying means for applying, to a portion which becomes the cutoff section, a force Pm which resists a thrust force Pt required for the cutting and a weight Pw of the cutoff section, at the time of the cutting.

The cutting is performed, when the disc-like cutting means passes through the cut portion of the honeycomb dried body. The cut portion is a portion at which the honeycomb dried body is cut, and is a portion at which the body is separated into the product section and the cutoff section. The cut portion may include one portion, two portions or three or more portions. When the cut portion includes two portions, the honeycomb dried body whose outer shape is the pillar body is cut perpendicularly to the axial direction to separate the body into the product section and two cutoff sections. As the disc-like cutting means, a wheel grindstone, a blade, a chip saw or a (rounded) band saw can be employed. Especially preferable cutting means is the wheel grindstone.

As the force applying means, an elastic member such as a spring can be employed, but in the honeycomb dried body cutting device according to the present invention, a generation source of the force Pm in spring force applying means is preferably an air cylinder.

As described above, the conveyance means may convey the cutting means. The force applying means applies the force Pm to the portion which becomes the cutoff section (after cut), at the time of the cutting. Therefore, when the disc-like cutting means passes through the cut portion of the honeycomb dried body (at the time of the cutting), the force applying means has to be positioned in the vicinity of the honeycomb dried body. However, there is not any special restrictions on the position where the force applying means is disposed, and the force applying means may be fixed to the vicinity of the cutting means. However, in the honeycomb dried body cutting device according to the present invention, the conveyance means preferably conveys the support means, and the force applying means is preferably fixed to the support means.

The weight Pw is a force (a unit is [N] or [gf]) unlike a mass. In the cutting method of the honeycomb dried body and the honeycomb dried body cutting device according to the present invention, $Pt+Pw \leq Pm$ represents a balance of the forces. The thrust force Pt required for the cutting is a force which is orthogonal to a cutting force Pc in a circumferential tangential direction of the (round) surface of the honeycomb dried body perpendicular to the axial direction, when the outer shape of the honeycomb dried body is, for example, a columnar body. This thrust force is equal to a cutting resistance. Moreover, the thrust force Pt is usually in a relation of being equal to a value obtained by multiplying the cutting force Pc by a coefficient k (k=1.5 to 3). Therefore, in the cutting method of the honeycomb dried body and the honeycomb dried body cutting device according to the present invention, $Pt+Pw \leq Pm$ can be replaced with $(Pc \times k)+Pw \leq Pm$.

It is to be noted that the honeycomb dried body is cut while applying, to the portion which becomes the cutoff section, the force Pm which resists the thrust force Pt required for the cutting and the weight Pw of the cutoff section. The present invention can preferably be applied even to a case where the outer shape of the honeycomb dried body is an elliptic pillar body (the surface perpendicular to the axial direction is elliptic) or a heteromorphic pillar body (the surface perpendicular to the axial direction is heteromorphic), as long as the conditions of $Pt+Pw \leq Pm$ are established.

Effect of the Invention

In a cutting method of a honeycomb dried body according to the present invention, the honeycomb dried body is cut while applying, to a portion which becomes a cutoff section (after cut), a force Pm which resists a thrust force Pt required for the cutting and a weight Pw of the cutoff section. At the time of the cutting, the cutoff section to be separated is immobile, or the cutoff section moves in a direction opposite to the thrust force. Therefore, part of a product section is not peeled off owing to the cutoff section, and the generation of cracks is prevented.

When a grindstone which is disc-like cutting means continues to be used for a long period of time, abrasive grains of the grindstone wear, abrade and fall to increase a processing resistance, whereby the cracks are easily generated. However, according to the present invention, the movement of the cutoff section is prevented, or the cracks can be generated in the cutoff section (not in the product section). Therefore, such problems can be avoided, also when the processing resistance becomes large owing to the above situations. In consequence, the life of the grindstone lengthens.

Moreover, when a cutting speed is raised, the processing resistance becomes large (even when the abrasive grains are not deteriorated). The generation of the cracks in excess of a material strength easily occurs. However, according to the present invention, the movement of the cutoff section is prevented, or the cracks can be generated in the cutoff section (not in the product section). Therefore, even when the cutting speed is raised, such problems can be avoided. In consequence, an efficiency in a honeycomb dried body cutting step enhances, and hence efficiencies of honeycomb structure manufacturing steps enhance.

Furthermore, when the cutting object is the honeycomb dried body having the large diameter, the cutoff section also becomes large and heavy, and a contact area of the grindstone becomes large. Therefore, as compared with a small diameter, the processing resistance becomes large (even when the abrasive grains are not deteriorated), and the generation of the cracks easily occurs. However, according to the present invention, the movement of the cutoff section can be prevented or the cracks can be generated in the cutoff section, while taking, into consideration, the weight of the cutoff section which becomes large and heavy. Consequently, also when the cutting object is the honeycomb dried body having the large diameter, such problems can be avoided.

In a preferable configuration of the cutting method of the honeycomb dried body according to the present invention, when $Pt+Pw \leq Pm$ is satisfied, i.e., when $Pt+Pw<Pm$ or $Pt+Pw=Pm$ is satisfied, the above effects can easily be obtained.

In a preferable configuration of the cutting method of the honeycomb dried body according to the present invention, the force Pm is applied to the vicinity of a cut portion as a portion at which the honeycomb dried body is separated into the product section and the cutoff section, at the end of the cutting. That is, the force Pm acts on a place limitlessly close to a point at which a product is completely separated at the end of the cutting, and hence the above effect can securely be obtained.

A honeycomb dried body cutting device according to the present invention is specific means for carrying out the cutting method of the honeycomb dried body according to the present invention, and the device exerts an effect thereof, to actually obtain the above effect.

In a preferable configuration of the honeycomb dried body cutting device according to the present invention, a generation source of the force Pm in force applying means is an air cylinder, and hence the force Pm can easily be adjusted. Therefore, it is possible to easily select whether a force balance is Pt+Pw<Pm or Pt+Pw=Pm in accordance with a situation. Moreover, it is possible to easily cope with a case where the weight Pw of the cutoff section changes in accordance with the change of specifications of the honeycomb dried body which is the cutting object.

In a preferable configuration of the honeycomb dried body cutting device according to the present invention, conveyance means conveys support means, and the force applying means is fixed to the support means. Therefore, at the time of the cutting, a positional relation between the honeycomb dried body which is the cutting object and the force applying means is usually constant. Consequently, a direction of the force Pm which resists the thrust force Pt required for the cutting and the weight Pw of the cutoff section does not change, and hence it is possible to simplify constitutions of the force applying means and furthermore the device.

If the conveyance means conveys the support means, the force applying means is fixed to the vicinity of the cutting means. In this case, the force applying means fixed to the vicinity of the cutting means does not move in a case where the cutting means passes through the honeycomb dried body supported by the support means and conveyed. Therefore, the positional relation between the honeycomb dried body which is the cutting object and the force applying means changes during the cutting. In this case, a force direction changes. Consequently, there is required a contrivance (control) to adjust a force size so that the force Pm is kept constant during the cutting, or a contrivance (mechanism) in which the positional relation between the honeycomb dried body and the force applying means does not change during the cutting even when the force applying means is fixed to the vicinity of the cutting means. In either case, however, the device becomes complicated.

DETAILED DESCRIPTION OF THE INVENTION

Figure 1:
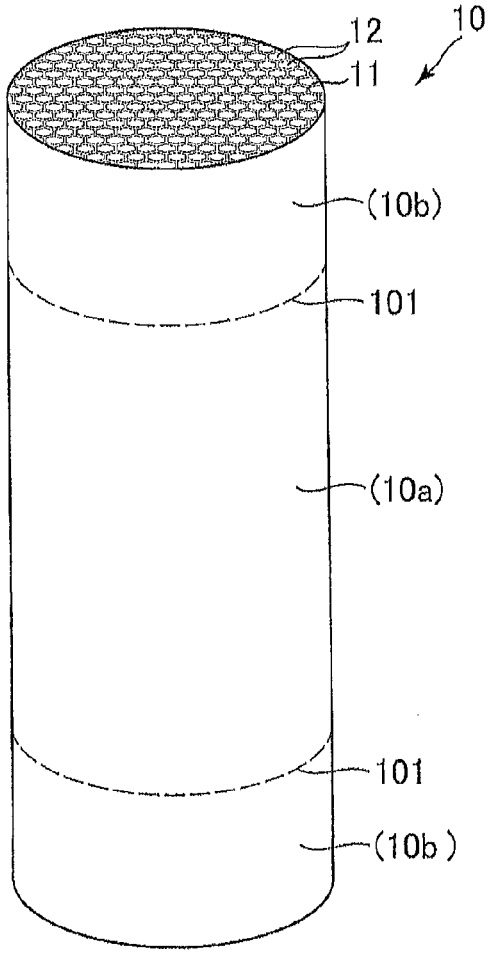
FIG. 1 is a perspective view schematically showing a honeycomb dried body which is a cutting object in a cutting method of a honeycomb dried body and a honeycomb dried body cutting device according to the present invention.

Hereinafter, embodiments of the present invention will be described suitably with reference to the drawings, but the present invention is not limited to these embodiments when interpreted, and various changes, modifications and improvements can be added thereto on the basis of ordinary knowledge of a person skilled in the art without departing from the scope of the present invention. For example, the drawings show suitable embodiments of the present invention, but the present invention is not limited by configurations shown in the drawings or information shown in the drawings. When the present invention is carried out or verified, means similar to or equivalent to those described in the present description, and suitable means will be described hereinafter.

First, a honeycomb dried body which is a cutting object in a cutting method of a honeycomb dried body and a honeycomb dried body cutting device according to the present invention will be described with reference to FIG. 1.

An illustrated honeycomb dried body 10 is a ceramic product whose outer shape is a columnar body including two end surfaces and a peripheral surface (see FIG. 1). In the body, there are formed a plurality of cells 12 partitioned by porous partition walls 11 including a large number of pores, to become through channels of a gas. In the honeycomb dried body 10, a sectional shape of the cells 12 perpendicular to an axial direction (equal to a shape which appears on each end surface (see FIG. 1)) is a hexagonal shape. In the honeycomb dried body which is the cutting object of the cutting method of the honeycomb dried body and the honeycomb dried body cutting device according to the present invention, the sectional shape of the cells 12 may be a quadrangular shape or a mixture of an octagonal shape and the quadrangular shape.

Main materials (aggregate particles) of a forming raw material of the honeycomb dried body 10 are a cordierite forming raw material such as alumina, kaolin and talc, or a ceramic material such as silicon carbide. A clay obtained by kneading these ceramic materials is extruded to form a honeycomb configuration. Then, an outer peripheral wall is formed to obtain a honeycomb formed body. When the honeycomb formed body is dried, the honeycomb dried body 10 can be obtained. Then, the honeycomb dried body 10 is fired, so that it is possible to obtain a honeycomb structure which can be applied as a filter element or a catalyst loading member. Prior to this firing, it is necessary to cut the honeycomb dried body into a desirable dimension, thereby finishing the outer shape. The cutting method of the honeycomb dried body and the honeycomb dried body cutting device according to the present invention are used for the cutting.

Figure 2A:
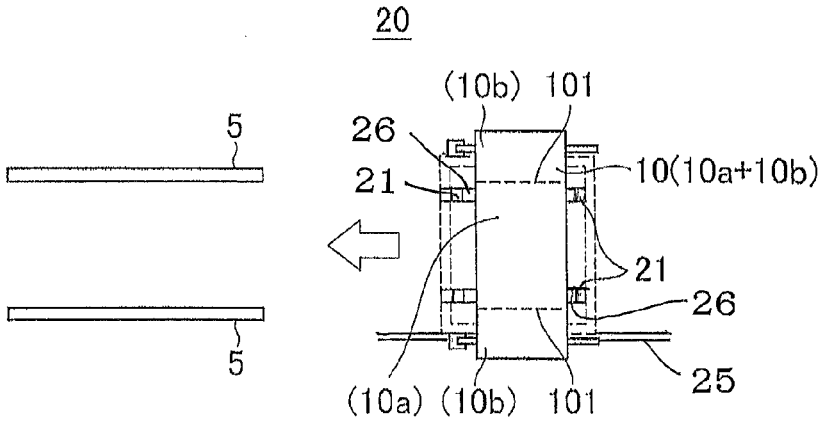
FIG. 2A is a plan view (a top plan view) schematically showing an embodiment of the honeycomb dried body cutting device according to the present invention.
Figure 2B:
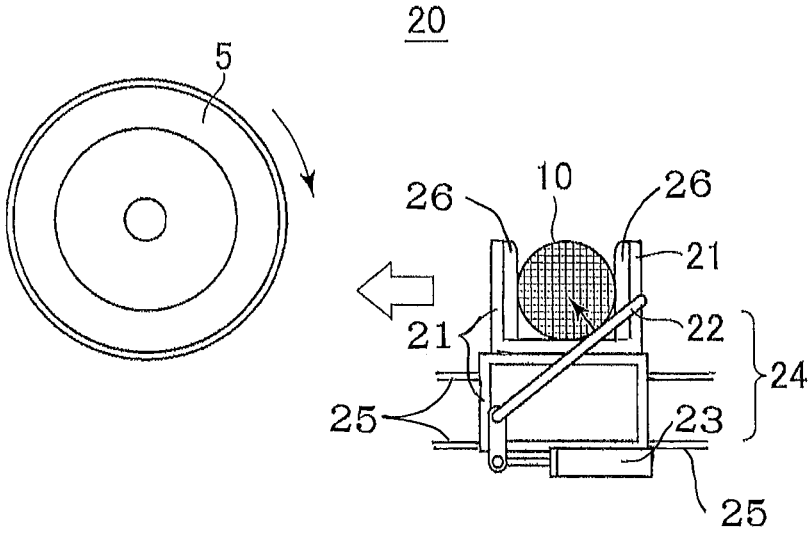
FIG. 2B is a front view of the honeycomb dried body cutting device shown in FIG. 2A.
Figure 3:
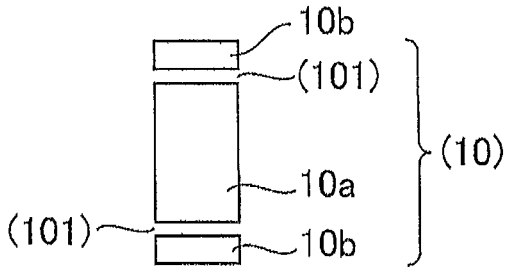
FIG. 3 is a plan view showing an example of the honeycomb dried body which is cut and separated into a product section and a cutoff section.

Next, an embodiment of the honeycomb dried body cutting device according to the present invention will be described with respect to a case where the honeycomb dried body 10 is cut with reference to FIG. 2A to FIG. 6. A honeycomb dried body cutting device 20 shown in FIG. 2A and FIG. 2B is a device to cut the honeycomb dried body 10, whose outer shape is a columnar body, perpendicularly to an axial direction, thereby separating the body into a product section 10*a* and two cutoff sections 10*b* (see FIG. 1 and FIG. 3).

The honeycomb dried body cutting device 20 includes a disc-like wheel grindstone 5 (cutting means). The wheel grindstone 5 cuts the honeycomb dried body 10 by rotating peripheral edges thereof. The device includes an abrasive grain layer 36 in the outer periphery of a thin circular plate-like base metal 35 provided with an attachment hole 38 (see FIG. 6). The abrasive grain layer 36 is obtained by electrodepositing a large number of abrasive grains or by holding the large number of abrasive grains with a bond material typified by a metal bond, a resin bond or the like.

Moreover, the honeycomb dried body cutting device 20 includes a container 21 (support means), a LM guide 25 (conveyance means) and a force applier 24 (force applying means). The container 21 contains the honeycomb dried body 10, and supports the body with a portion which becomes the product section 10*a* (after cut) while avoiding cut portions 101. The container 21 can be constituted of a steel material, and obtained, for example, by disposing a pad 26 on a portion which comes in contact with the honeycomb dried body 10. The LM guide 25 is a translatory unit which conveys the container 21.

Figure 4A:
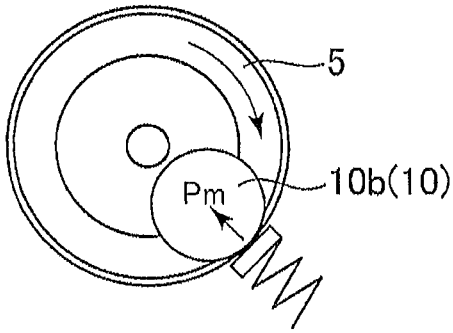
FIG. 4A is a schematic view for explaining a force Pm applied to a portion which becomes the cutoff section at the time of the cutting.
Figure 4B:
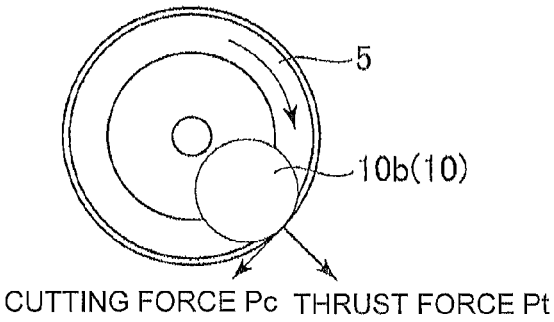
FIG. 4B is a schematic view for explaining a thrust force Pt and a cutting force Pc generated at the time of the cutting.
Figure 5:
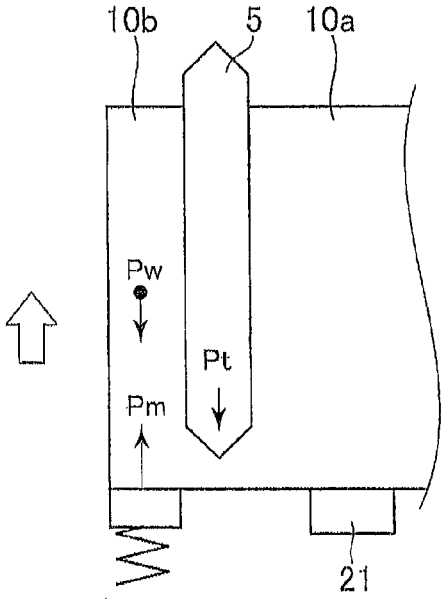
FIG. 5 is an enlarged plan view schematically showing that the honeycomb dried body is cut, and is a view for explaining the thrust force Pt required for the cutting, a weight Pw of the cutoff section, and the force Pm which resists the thrust force and the weight.
Figure 6:
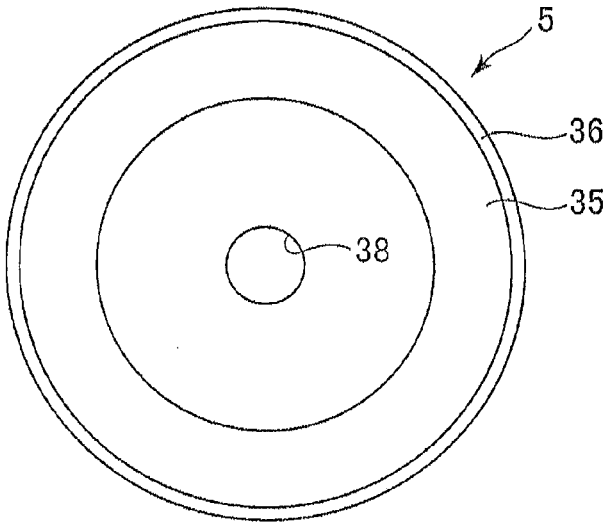
FIG. 6 is a view showing an example of cutting means constituting the honeycomb dried body cutting device according to the present invention, and is a front view showing a wheel grindstone.

The force applier 24 is a unit which applies, to portions which become the cutoff sections 10*b* (after cut), a force Pm (see FIG. 4A and FIG. 5) which resists a thrust force Pt required for the cutting (see FIG. 4B) and a weight Pw of each of the cutoff sections 10*b* (see FIG. 5), when cutting the body (see FIG. 5). The force applier 24 can be constituted of an air cylinder 23 and a pressing bar 22 fixed to the container 21 (see FIG. 2B). The air cylinder 23 is a generation source of the force Pm. The pressing bar 22 is a jig which actually applies the force Pm to the cutoff sections 10*b* (in the honeycomb dried body 10 after cut). In place of the air cylinder 23, a spring may be used. FIG. 4A and FIG. 5 show a spiral spring in place of the air cylinder 23.

In the honeycomb dried body cutting device 20, the wheel grindstone 5 is rotatably attached, but a position thereof is immobile (is not conveyed). The container 21 and the honeycomb dried body 10 supported by the container are conveyed. In the honeycomb dried body cutting device 20, the container 21 is conveyed by the LM guide 25 while rotating the wheel grindstone 5 so that the wheel grindstone passes through cut portions 101 of the honeycomb dried body 10 (in arrow directions of FIG. 2A, FIG. 2B and FIG. 5), in a state where the axial direction of the honeycomb dried body 10 is orthogonal to a planar direction of the wheel grindstone 5 (see FIG. 2A), whereby the honeycomb dried body is cut at the cut portions 101. While any cracks are not generated, the body is separated into the product section 10*a* and the two cutoff sections 10*b*.

Figure 7:
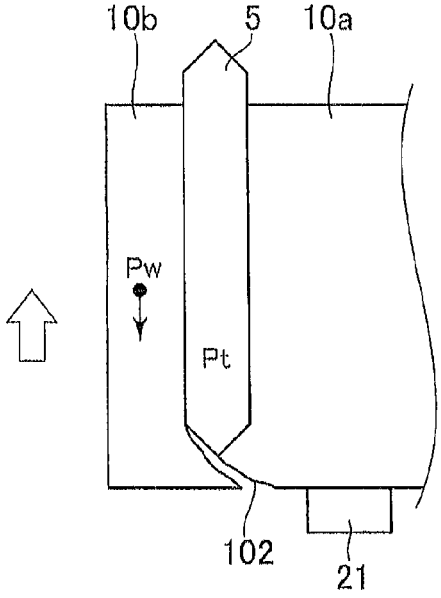
FIG. 7 is an enlarged plan view schematically showing that the force Pm cannot be applied but the honeycomb dried body is cut, in contrast with FIG. 5, and is a view showing a problem involved in a conventional honeycomb dried body cutting device.

When the force applier 24 is not present and the force Pm which resists the thrust force Pt required for the cutting and the weight Pw of each of the cutoff sections 10*b* is not applied to the portions which become the cutoff sections 10*b*, a relation of a processing resistance>a base material strength of an uncut portion is produced during the cutting, and the portions which become the cutoff sections 10*b* move in a direction of the thrust force. A crack 102 is generated in a portion which becomes the product section 10*a* (see FIG. 7). However, according to the honeycomb dried body cutting device 20 including the force applier 24, such a problem does not occur.

Figure 8:
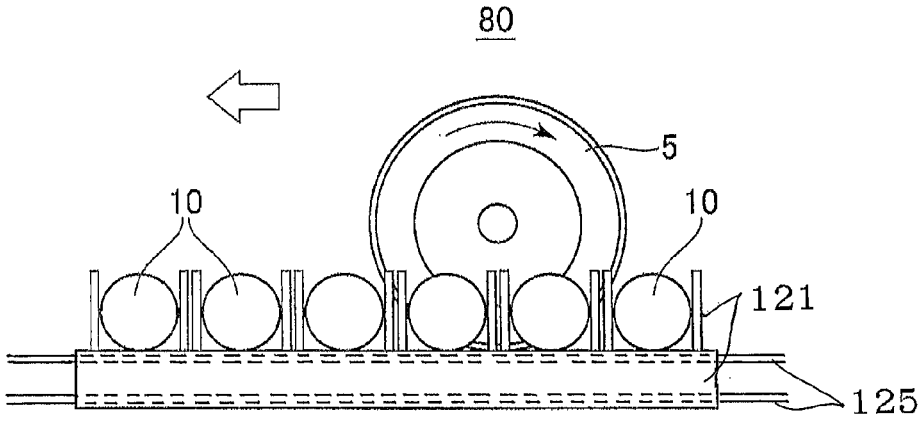
FIG. 8 is a view schematically showing another embodiment of the honeycomb dried body cutting device according to the present invention, and is a front view showing that the cutting is being performed.

Next, another embodiment of a honeycomb dried body cutting device according to the present invention will be described with reference to FIG. 8. In a honeycomb dried body cutting device 80 shown in FIG. 8, a container 121 contains and supports (for example) six honeycomb dried bodies 10. According to the embodiment, when the container 121 is conveyed by an LM guide 125 while rotating a wheel grindstone 5 so that the wheel grindstone 5 passes through cut portions of the honeycomb dried bodies 10, the six honeycomb dried bodies 10 can continuously be cut. In this case, six force appliers 24 are required every six honeycomb dried bodies 10. Except these constitutions, the honeycomb dried body cutting device 80 employs a constitution which conforms to the honeycomb dried body cutting device 20 (the description thereof is omitted).

EXAMPLES

Hereinafter, the present invention will be described in more detail with respect to examples, but the present invention is not limited to these examples.

Example 1

A cordierite forming raw material, an organic binder and water were mixed and further kneaded to obtain a clay, and the clay was extruded with an extrusion former. Afterward, an outer peripheral wall was formed to obtain a honeycomb formed body. Then, the honeycomb formed body was dried with a drier, to obtain a honeycomb dried body whose outer shape was a columnar body. This was obtained as a honeycomb dried body 10 to be cut. An axial length of the honeycomb dried body 10 was 400 mm, and a diameter of a cross section thereof perpendicular to an axis was 152 mm. A cell sectional shape was a quadrangular shape, a cell density was 46.5 cells/cm$^2$, and a thickness of partition walls was 300 μm.

Then, a thrust force Pt (a cutting resistance) of 300 [gf] required for the cutting was beforehand obtained. Moreover, a weight Pw of one of cutoff sections 10*b* was 160 [gf]. A sum of the thrust force Pt and the weight Pw of the cutoff section was 460 [gf]. On the other hand, the above-mentioned honeycomb dried body cutting device 20 (FIG. 2A and FIG. 2B) was used to regulate a pressure of an air cylinder with a regulator. This pressure was converted into a force on the basis of a cylinder diameter and a cylinder rod system, and the force was multiplied by a distance between a support point and an action point, to calculate a moment, whereby a force Pm was set to 260 [gf]. Then, the honeycomb dried body 10 was cut to be separated into a product section 10*a* and two cutoff sections 10*b*. In this case, as to the honeycomb dried body cutting device 20, there was obtained, in the drawing, a point where the product section 10*a* was completely cut off when a wheel grindstone 5 passes through cut portions of the honeycomb dried body 10, and a force applier 24 was disposed at a point which was as close as possible to the obtained point so that the force Pm acts on the point. As the wheel grindstone 5, a wheel grindstone in which cracks were generated when used in a usual state (where the present invention was not applied) was used, and revolutions thereof were set to 1500 to 3000 rpm. Moreover, a conveyance speed (a feed speed) of a container 21 (the honeycomb dried body) was set to be about 1.5 times that of usual conditions.

Figure 11:
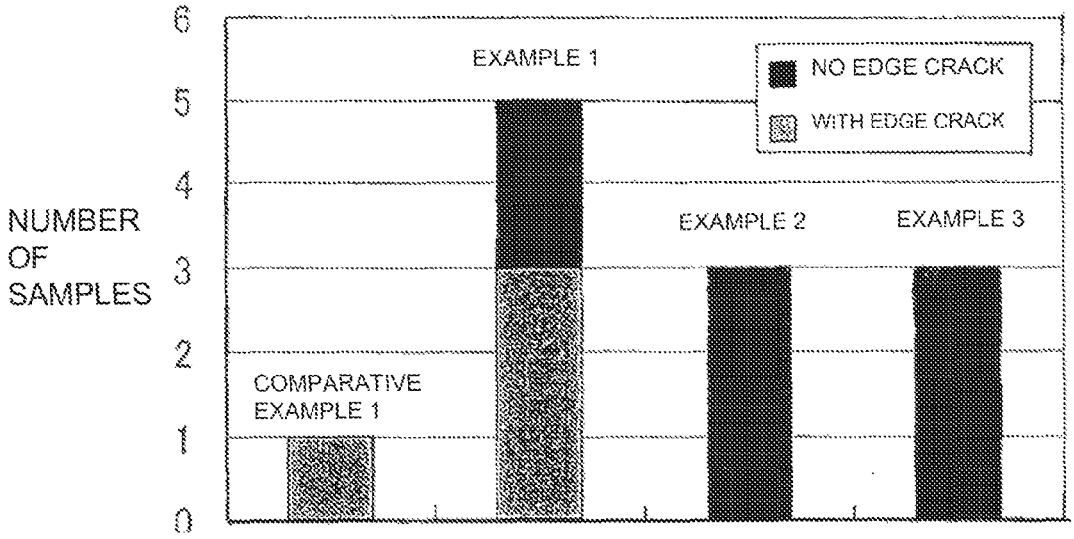
FIG. 11 is a graph showing the results of the examples.

When five honeycomb dried bodies 10 having the same specifications were cut on the same conditions, it was confirmed that in three of the bodies, a crack was generated at an edge of the product section 10*a* (the vicinity of an outer peripheral portion) (the edge crack was present), but in two of the bodies, any cracks were not generated (no edge crack). The results are shown in FIG. 11.

Example 2

A honeycomb dried body 10 was cut in the same manner as in Example 1 except that a force Pm was set to 520 [gf]. When three honeycomb dried bodies 10 having the same specifications were cut on the same conditions, cracks were not generated in all of the three bodies (no edge crack). The results are shown in FIG. 11.

Example 3

A honeycomb dried body 10 was cut in the same manner as in Example 1 except that a force Pm was set to 1070 [gf]. When three honeycomb dried bodies 10 having the same specifications were cut on the same conditions, cracks were not generated in all of the three bodies (no edge crack). The results are shown in FIG. 11.

Comparative Example 1

When a honeycomb dried body 10 was cut in the same manner as in Example 1 except that a force Pm was set to 0 [gf], a crack was generated at an edge of a product section 10*a* (the vicinity of an outer peripheral portion) (with edge crack). The results are shown in FIG. 11.

[Calculation of Thrust Force Pt]

Figure 9:
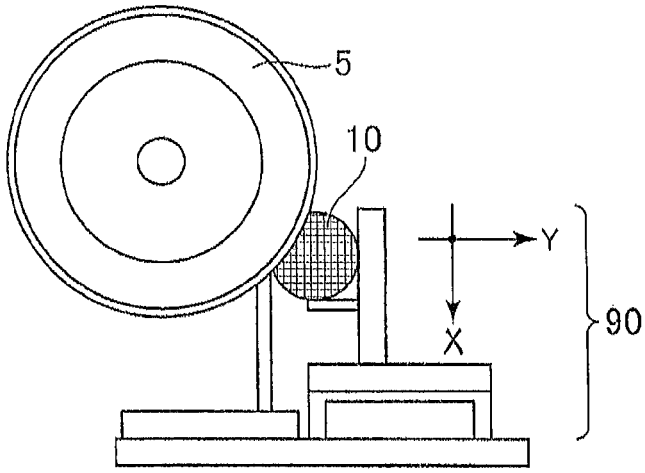
FIG. 9 is a front view schematically showing a constitution of a thrust force (a cutting resistance) measurement device for use in examples.
Figure 10:
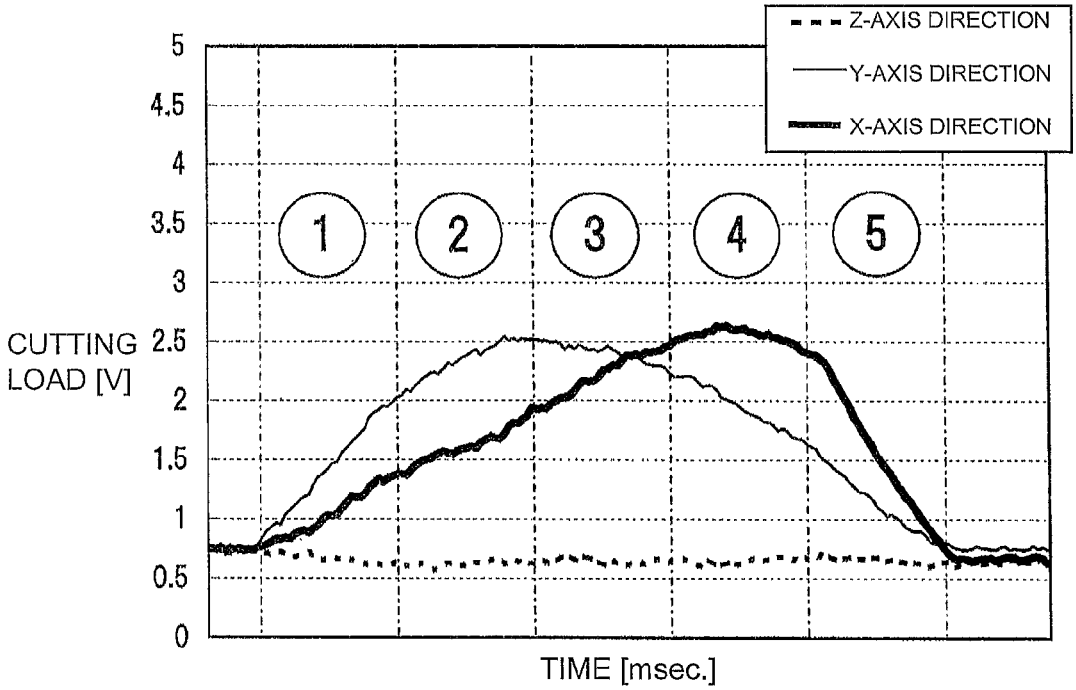
FIG. 10 is a graph showing output results of a cutting power meter constituting the thrust force (the cutting resistance) measurement device shown in FIG. 9.

A cutting power (a cutting resistance) measurement device shown in FIG. 9 was used. This cutting power measurement device is a device which obtains a cutting power with a cutting power meter 90 (model No. 9257B manufactured by Kistler Co.) at the time of cutting by use of the same wheel grindstone 5 and honeycomb dried body 10 as those used in the examples. Specifically, as shown in FIG. 10, loads in an X-axis direction, a Y-axis direction and a Z-axis direction in a cutting process are output as voltage values [V] from the cutting power meter 90, respectively. Therefore, the cutting process were divided into five equal processes (segments of circled numerals 1 to 5 shown in FIG. 10: abscissa), and a time-average value of resultant forces of the loads (the voltage values) of the last process (the fifth process (the rightmost process) in FIG. 10) in the Y-direction and X-direction was determined as the maximum load which was applicable at a moment when the cutoff sections were cut off. This maximum load was obtained as a thrust force Pt. It is to be noted that the number of samples shown along the abscissa (the time axis) of FIG. 10 in each of the X-axis direction, the Y-axis direction and the Z-axis direction is 178, and a sampling period is 10 msec.

[Calculation of Weight Pw of Cutoff Section]

A weight of one cutoff section 10*b* obtained by cutting a honeycomb dried body at the same cut portion as in the examples was beforehand measured with a weight meter (Model No. IB-5000 manufactured by AS ONE Co.).

INDUSTRIAL APPLICABILITY

A cutting method of a honeycomb dried body and a honeycomb dried body cutting device according to the present invention are suitably utilized as means for cutting a honeycomb dried body in a manufacturing process of a honeycomb structure which is often used as a filter element or a catalyst loading member.

DESCRIPTION OF REFERENCE SIGNS

5: wheel grindstone, 10: honeycomb dried body, 10*a*: product section, 10*b*: cutoff section, 11: partition wall, 12: cell, 20 and 80: honeycomb dried body cutting device, 21: container, 22: pressing bar, 23: air cylinder, 24: force applier, 25 and 125: LM guide, 26: pad, 35: base metal, 36: abrasive grain layer, 38: attachment hole, 90: cutting power meter, 101: cut portion, and 121: container.

What is claimed is:

1. A cutting method of a honeycomb dried body, comprising:

providing the honeycomb dried body, whose outer shape is a pillar body, cutting the honeycomb dried body perpendicularly to an axial direction with a thrust force Pt imposed on the honeycomb dried body by a cutting mechanism to separate the body into a product section and a cutoff section, the cutoff section having a weight Pw at the end of cutting, and supporting the cutoff section during the cutting, with only a single straight bar surface oriented to apply a single normal vector force Pm that counteracts both the weight of the cutoff section Pw and the thrust force Pt to immobilize the cutoff section during the cutting.

2. The cutting method of the honeycomb dried body according to claim 1, wherein Pt+Pw<Pm is satisfied.

3. The cutting method of the honeycomb dried body according to claim 1, wherein Pt+Pw=Pm is satisfied.

4. The cutting method of the honeycomb dried body according to claim 1, wherein the force Pm is applied to the vicinity of a cut portion as a portion at which the honeycomb dried body is separated into the product section and the cutoff section at the end of the cutting.

5. The cutting method of the honeycomb dried body according to claim 2, wherein the force Pm is applied to the vicinity of a cut portion as a portion at which the honeycomb dried body is separated into the product section and the cutoff section at the end of the cutting.

6. The cutting method of the honeycomb dried body according to claim 3, wherein the force Pm is applied to the vicinity of a cut portion as a portion at which the honeycomb dried body is separated into the product section and the cutoff section at the end of the cutting.

7. The cutting method of the honeycomb dried body according to claim 1, wherein the outer shape of the honeycomb dried body is a columnar body.

8. The cutting method of the honeycomb dried body according to claim 2, wherein the outer shape of the honeycomb dried body is a columnar body.

9. The cutting method of the honeycomb dried body according to claim 3, wherein the outer shape of the honeycomb dried body is a columnar body.

10. The cutting method of the honeycomb dried body according to claim 4, wherein the outer shape of the honeycomb dried body is a columnar body.

11. A honeycomb dried body cutting device which cuts a honeycomb dried body, whose outer shape is a pillar body, perpendicularly to an axial direction, to separate the body into a product section and a cutoff section, comprising:

disc-like cutting means for cutting the honeycomb dried body by rotating peripheral edges thereof and applying a thrust force Pt imposed on the honeycomb dried body:

support means for supporting a portion of the honeycomb dried body that becomes the product section;

conveyance means for conveying the cutting means or the support means so that the disc-like cutting means passes through a cut portion of the honeycomb dried body, in a state where the axial direction of the honeycomb dried body which is the pillar body is orthogonal to a planar direction of the disc-like cutting means; and force applying means for applying, at the time of cutting and to a portion which becomes the cutoff section, a single planar surface oriented to apply a single normal vector force Pm that counteracts both the weight of the cutoff section Pw and the thrust force Pt to immobilize the cutoff section during the cutting.

12. The honeycomb dried body cutting device according to claim 11, wherein a generation source of the force Pm in the force applying means is an air cylinder.

13. The honeycomb dried body cutting device according to claim 11, wherein the conveyance means conveys the support means, and the force applying means is fixed to the support means.

14. The honeycomb dried body cutting device according to claim 12, wherein the conveyance means conveys the support means, and the force applying means is fixed to the support means.

* * * * *

UNITED STATES PATENT AND TRADEMARK OFFICE

CERTIFICATE OF CORRECTION

PATENT NO. : 9,073,234 B2
APPLICATION NO. : 13/433018
DATED : July 7, 2015
INVENTOR(S) : Yuji Ito, Yohei Takemori and Atsushi Watanabe It is certified that error appears in the above-identified patent and that said Letters Patent is hereby corrected as shown below:

On the Title Page, Inventors, Item (75)

Please change: "Inventors: Yuji Ito, Nagoya (JP); Yohei Takemori, Nagoya (JP); Atsushi Watanbe, Inazawa (JP)" to -- Inventors: Yuji Ito, Nagoya (JP); Yohei Takemori, Nagoya (JP); Atsushi Watanabe, Inazawa (JP) --

Signed and Sealed this
Fifteenth Day of September, 2015

Michelle K. Lee

Michelle K. Lee
*Director of the United States Patent and Trademark Office*